US007331883B2

(12) United States Patent
Goldberg

(10) Patent No.: US 7,331,883 B2
(45) Date of Patent: Feb. 19, 2008

(54) SPINNING NUT BASKETBALL ELEVATOR SYSTEM

(75) Inventor: Michael Goldberg, Tampa, FL (US)

(73) Assignee: Russell Corporation, Atlanta, GA (US)

( * ) Notice: Subject to any disclaimer, the term of this patent is extended or adjusted under 35 U.S.C. 154(b) by 183 days.

(21) Appl. No.: 11/235,099

(22) Filed: Sep. 27, 2005

(65) Prior Publication Data

US 2007/0072707 A1 Mar. 29, 2007

(51) Int. Cl.
*A63B 63/08* (2006.01)

(52) U.S. Cl. ..... 473/483; D21/701

(58) Field of Classification Search ..... 473/483, 473/481, 484; D21/701; 248/280.11, 283.11
See application file for complete search history.

(56) References Cited

U.S. PATENT DOCUMENTS

| | | | |
|---|---|---|---|
| 78,570 | A | 6/1868 | Bragg |
| 169,382 | A | 11/1875 | Starr |
| 171,746 | A | 1/1876 | Starr |
| 213,775 | A | 4/1879 | Redman et al. |
| 289,653 | A | 12/1883 | Haynes |
| 325,551 | A | 9/1885 | Lukens |
| 446,464 | A | 2/1891 | Nittinger |
| 480,261 | A | 8/1892 | Herr |
| 482,207 | A | 9/1892 | Streeter |
| 532,132 | A | 1/1895 | Zaremba |
| 806,790 | A | 12/1905 | Foersterling |
| 876,525 | A | 1/1908 | Chrichester |
| 1,050,672 | A | 1/1913 | Macintosh |
| 1,139,581 | A | 5/1915 | Riley |
| 1,988,037 | A | 1/1935 | Furrer |
| 2,227,310 | A | 12/1940 | Hoppes et al. |
| 2,313,188 | A | 3/1943 | Woodburn |
| 2,379,572 | A | 7/1945 | Gibson |
| 2,391,872 | A | 1/1946 | Berg |
| 2,557,604 | A | 6/1951 | Invidiato |
| 2,784,770 | A | 3/1957 | Herr |
| 2,986,395 | A | 5/1961 | Sheftel |
| 3,017,183 | A | 1/1962 | Chalcroft |
| 3,237,902 | A | 3/1966 | Hayashi |
| 3,329,427 | A | 7/1967 | Bearson |
| 3,341,197 | A | 9/1967 | Bottorff |
| 3,352,580 | A | 11/1967 | Kurz et al. |
| 3,368,847 | A | 2/1968 | Langmead |
| 3,462,102 | A | 8/1969 | Rivers |
| 3,467,377 | A | 9/1969 | Miller et al. |
| 3,490,727 | A | 1/1970 | Miller |
| 3,586,324 | A | 6/1971 | Bearson |
| 3,614,099 | A | 10/1971 | Samo |
| 3,765,676 | A | 10/1973 | Bearson |

(Continued)

FOREIGN PATENT DOCUMENTS

| | | |
|---|---|---|
| WO | WO 99/38579 | 8/1999 |

(Continued)

*Primary Examiner*—Eugene Kim
*Assistant Examiner*—M. Chambers

(57) ABSTRACT

The present invention relates to an apparatus and method for adjusting the height of a basketball backboard and hoop assembly. One embodiment of the present invention may include an adjustment arm in telescoping relation with a threaded rod. The present invention may also include a threaded nut rotatably connected to the adjustment arm and in threadable engagement with the threaded rod such that rotation of the threaded nut on the threaded rod induces an adjustment in the vertical height of the basketball backboard and hoop assembly.

12 Claims, 4 Drawing Sheets

U.S. PATENT DOCUMENTS 3,802,702 A 4/1974 Pulley
3,880,392 A 4/1975 Duganich
3,881,724 A * 5/1975 Beveridge ..... 473/472
4,132,385 A * 1/1979 DeRouen et al. ..... 251/147
4,145,044 A 3/1979 Wilson et al.
4,151,989 A 5/1979 Dittrich
4,311,338 A 1/1982 Moorhouse
4,330,101 A 5/1982 Andersen
4,395,040 A * 7/1983 White ..... 473/484
4,412,679 A 11/1983 Mahoney
4,465,277 A 8/1984 Dittrich
4,640,549 A 2/1987 Yokota
4,684,129 A 8/1987 Andersen et al.
4,770,463 A 9/1988 Nishino
4,781,375 A 11/1988 Nye
4,793,611 A 12/1988 Thornell
4,798,381 A 1/1989 Dadbeh
4,805,904 A 2/1989 Nye
4,828,323 A 5/1989 Brodersen et al.
4,881,734 A 11/1989 Nye
5,082,261 A 1/1992 Pelfrey
5,133,547 A 7/1992 Pardi
5,211,393 A 5/1993 Rolffs et al.
5,292,118 A 3/1994 Allen et al.
5,375,835 A 12/1994 Van Nimwegen et al.
5,377,976 A 1/1995 Matherne et al.
5,401,015 A 3/1995 Woodall
5,465,957 A 11/1995 Schroeder
5,478,068 A 12/1995 Schroeder
5,503,390 A 4/1996 Hall
5,524,883 A 6/1996 Allen et al.
5,601,284 A 2/1997 Blackwell et al.
5,695,417 A 12/1997 Winter et al.
5,720,679 A 2/1998 Schroeder
5,772,167 A 6/1998 Koole
5,792,010 A 8/1998 Allen et al.
5,795,253 A 8/1998 Allen
5,800,295 A * 9/1998 Rogitz ..... 473/483
5,823,898 A 10/1998 Wang
5,826,846 A 10/1998 Buccieri et al.
5,879,247 A 3/1999 Winter et al.
5,951,416 A 9/1999 Allen et al.
6,077,177 A 6/2000 Winter et al.
6,135,901 A * 10/2000 van Nimwegen ..... 473/484
6,302,811 B1 * 10/2001 Topham ..... 473/484
6,312,350 B1 11/2001 White
6,419,597 B1 * 7/2002 van Nimwegen et al. .. 473/484
2001/0024984 A1 9/2001 Stanford et al.
2002/0094890 A1 7/2002 White et al.
2006/0276273 A1 12/2006 Perry et al.

FOREIGN PATENT DOCUMENTS

WO WO 2004/058362 7/2004

* cited by examiner

SPINNING NUT BASKETBALL ELEVATOR SYSTEM

FIELD OF THE INVENTION

The present invention is related to an apparatus and method for adjusting the height of a basketball backboard/hoop assembly.

BACKGROUND OF THE INVENTION

Basketball has become an increasing popular sport with backyard and neighborhood basketball goals increasing in popularity. These backyard basketball goals often function well for families and communities with a wide variety of playing, including grown adults and small children. Consequently, adjustable height basketball goals have become a favorite product of the backyard or personal basketball courts where individuals over various heights and skills desire to play on the same basketball goal.

Many such adjustable height basketball goals include movable support arms that may be locked in place to support the basketball goal at a given height above a playing surface. To lock the support arms in place, clamps, locking pins, and other mechanisms known in the art are often incorporated into an adjustment handle or mechanism which may be manipulated to unlock, adjust the height of the basketball goal, and finally relock the basketball goal at the desired height. Unfortunately, upon release of the locking mechanism, the weight of the basketball backboard and goal may be suddenly released, causing the adjustment handle to "jump" and surprise the user or consumer.

One attempt to counter act the sudden release of the weight of the basketball backboard and goal, is to incorporate an air spring or other type of spring mechanism, which may be configured and positioned to act on the supports arms in the opposite direction of the weight of the basketball backboard and goal. Unfortunately, the springs force varies the height of the basketball goal and the spring mechanisms degrade overtime. As such, the adjustment handle may still jump or suddenly release the weight of the backboard and goal upon unlocking the adjustment mechanism.

Another disadvantage of traditional adjustable height systems is that a precise, smooth height adjustment is very difficult. During adjustment, a user must support the weight of the basketball goal while making height adjustments, finally positioning the backboard precisely before locking the goal in place. Even if an air spring is used, the weight of the backboard and the goal may make controlling the weight and positioning the basketball goal precisely very difficult for smaller individuals, such as children.

Additionally, traditional locking mechanisms often failed to provide sufficiently small adjustment increments and to reliably secure the height of the basketball goal. For example, a clamp has been used to secure the adjustment handle to an adjustment pole at various locations in order to position the height of the basketball goal. While the clamp does provide continuous adjustment at any height, the clamp suffers from degradation and slippage on the adjustment pole, especially when the clamp experiences heavy load, such as a player dunking a basketball.

Therefore, there is a need for an adjustable basketball goal system that can be smoothly and easily adjusted.

SUMMARY OF THE INVENTION

The present invention is related to an apparatus and method for adjusting the height of a basketball backboard/hoop assembly.

One embodiment of the present invention may include an apparatus for adjusting the height of a basketball backboard and hoop. The apparatus may include a support pole, at least one elevator arm rotatably connected to both the basketball backboard and the basketball support pole, an adjustment pole rotatably connected to the at least one elevator arm. The apparatus may also include a threaded rod rotatably connected to the support pole, a threaded nut attached to the adjustment pole and configured to threadably engage with the threaded rod wherein rotation of the threaded nut adjusts the height of the basketball backboard.

Another embodiment of the present invention may include an apparatus for adjusting the height of a basketball backboard and hoop. The apparatus may include a support pole and at least one elevator arm rotatably connected to both the basketball backboard and the support pole. The apparatus may also include an adjustment device connecting the at least one elevator arm to the support pole, the adjustment device having a threaded rod in telescoping arrangement with an adjustment arm. The adjustment device may further include a threaded nut rotatably connected to the adjustment arm and threadably engaged to the threaded rod and a threaded nut being configured to rotate in response to a force applied to the adjustment arm wherein rotation of the threaded nut adjusts the height of the basketball backboard and hoop.

Another embodiment of the present invention may include a method for adjusting a height of a basketball goal, the basketball goal having a backboard and a hoop supported by a basketball support pole and at least one elevator arm rotatably connected to the support pole and the backboard. The method may include the step of releasing a threaded nut with an adjustment arm in a first position, the threaded nut being rotatably connected to the adjustment arm which is connected to the at least one elevator arm, the threaded nut being threadably engaged to a threaded rod which is connected to the support pole. The method may also include the step of applying a force to the adjustment arm sufficient to induce rotation of the threaded nut around the threaded rod whereby rotation of the threaded rod is configured to adjust the height of the backboard and hoop by translating the adjustment arm relative to the threaded rod. The method may also include the step of engaging the threaded nut with the adjustment arm in a second position such that the backboard and the hoop are substantially fixed.

These and other objects and advantages of the invention will be apparent from the following description, the accompanying drawings and the appended claims.

BRIEF DESCRIPTION OF THE DRAWINGS

While the specification concludes with claims particularly pointing out and distinctly claiming the present invention, it is believed the same will be better understood from the following description taken in conjunction with the accompanying drawings, which illustrate, in a non-limiting fashion, the best mode presently contemplated for carrying out the present invention, and in which like reference numerals designate like parts throughout the Figures, wherein:

DETAILED DESCRIPTION OF THE INVENTION

The present disclosure will now be described more fully with reference to the Figures in which various embodiments of the present invention are shown. The subject matter of this disclosure may, however, be embodied in many different forms and should not be construed as being limited to the embodiments set forth herein.

Figure 1A:
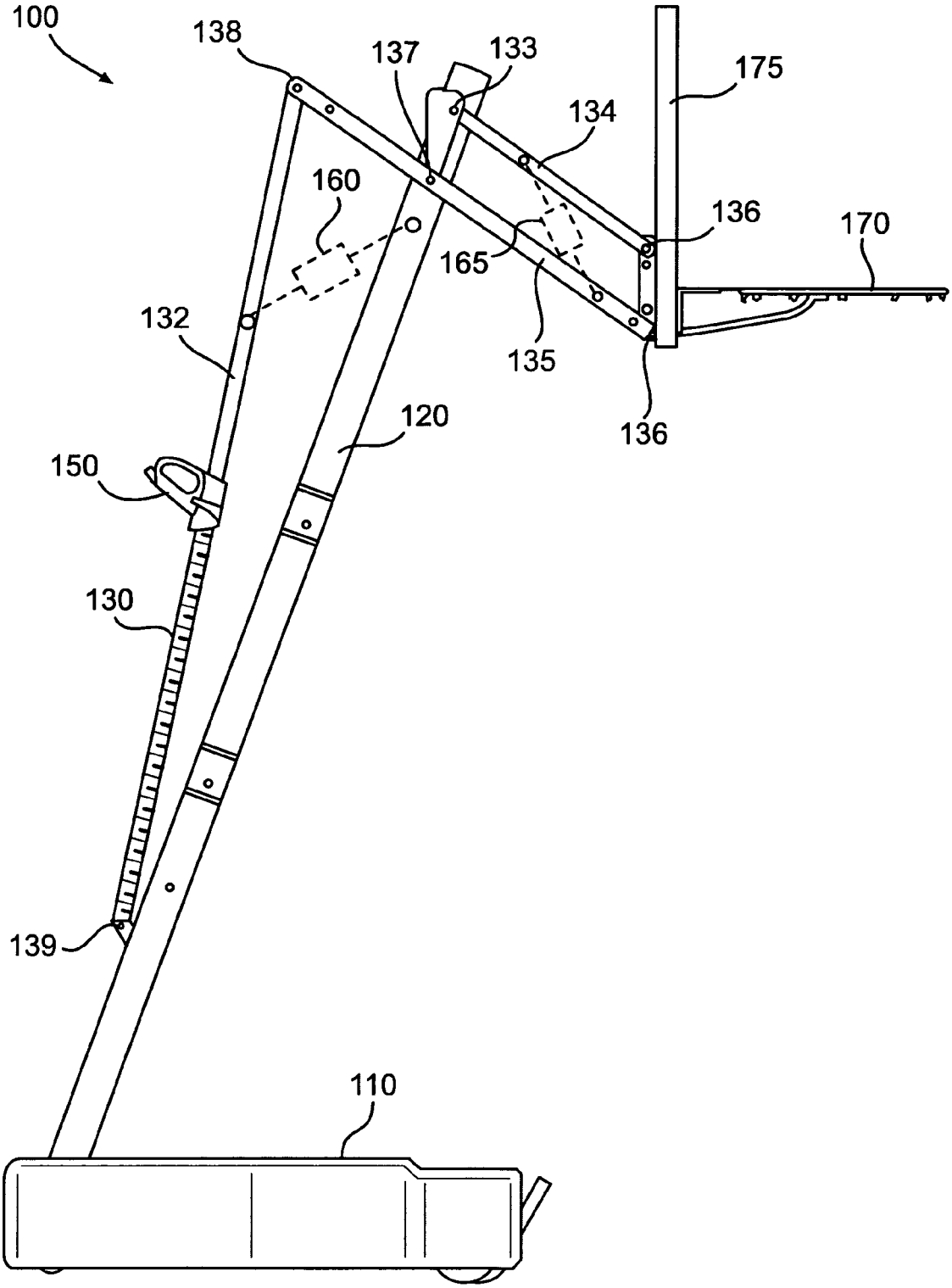
FIG. 1A shows a side view of an adjustable basketball goal system utilizing the present invention.

FIG. 1A shows a side view of an adjustable basketball goal system 100 according to an embodiment the present invention. The basketball goal system may include a rigid basketball support pole 120 extending from a base 110 in a substantially upward direction. While the embodiment shown in FIG. 1A illustrates the use of a movable base 110, the system may also be used where the basketball support pole 120 is fixed with respect to a playing surface (not shown). While a playing surface may be taken generally to mean the earth, it is also contemplated that the basketball support pole 120 may be fixed in concrete, an indoor floor of the type found in gymnasiums, asphalt or any basketball playing surface as would be known by one of skill in the art.

A basketball backboard 175 and hoop 170 may be attached to the basketball support pole 120 by a first elevator arm 134 and a second elevator arm 135. The elevator arms 134, 135 may be connected to the basketball support pole 120 (at points of attachment 136). The backboard 175 and hoop 170 may be attached at one end of the elevator arms 134, 135. The first elevator arm 134 may be attached at the opposite end to the basketball support pole 120 (at a point of attachment 133). The second elevator arm 135 may be connected between its ends to the basketball support pole 120 (at a point of attachment 137) and at one end to a first adjustment pole 132 (at a point of attachment 138). The points of attachment 133, 136, 137 and 138 may be rotatable connections, allowing the backboard 175 and elevator arms 134, 135 to pivot at each point of connection.

As stated above, the second end of the second elevator arm 135 may be attached to one end of a first adjustment pole 132. The second end of the first adjustment pole 132 may be attached to an adjustment system 150, discussed in greater detail below. The adjustment system 150 may also be movably attached to a second adjustment pole 130. The second adjustment pole 130 may also be rotatably attached at point 139 to the basketball support pole 120. While the lower adjustment tube 130 is shown in FIG. 1 as being rotatably attached to support pole 120, the lower adjustment tube 130 may also be rotatably attached to the base 110, the ground, a playing surface (not shown) or any other suitable mounting surface as would be known of one of ordinary skill in the art. Additionally, while FIG. 1 illustrates the first adjustment pole 132 being positioned below the second adjustment pole 130, it is contemplated that the two adjustment poles 130, 132 may be connected in the opposite manner, with the first adjustment pole 132 being positioned below the second adjustment pole 130.

As discussed below with reference to FIGS. 2A and 2B, the adjustment system 150 of the present invention may allow a user to easily and precisely adjust the height of the basketball backboard 175 and hoop 170. The first adjustment pole 132 may include a fixed length and the second adjustment pole 130 may include threaded rod. The threaded rod 130 may be configured to permit height adjustments to be made to the basketball backboard 175 and hoop 170. While the Figures show the second adjustment pole 130 as a threaded rod exposed to the elements, it is contemplated that the threaded rod may be covered, for example, by a telescoping tube or other such covering known in the art. A telescoping tube may be incorporated to protect the second adjustment pole 130 and may be configured to attach to both the adjustment system 150 and the basketball support pole 139. Further, the covering tube may be configured to increase or decrease in length as height adjustments are made such that the threaded rod 130 remains covered at all times.

When the adjustment system 150 is locked in place, the basketball backboard 175 and hoop 170 may be held in place without being permitted to move. Upon unlocking the adjustment system 150, the adjustment system 150 may moved along the axial length of the threaded rod 130. As discussed with reference to FIGS. 2A and 2B below, movement of the adjustment system 150 upwards or downwards along the length of the threaded rod 130 may result in a change in the height of the backboard 175 and hoop 170.

As would be apparent to one of ordinary skill, movement of the adjustment system 150 along the threaded rod 130 may result in rotation about the pivot joints 136, 137, 138 and 139. Such rotation may be configured to permit adjustment poles 132 and 130, the elevator arms 135 and 134, and the backboard 175 to move relative to each other such that the backboard 175 may be raised or lowered while maintaining the vertical orientation of the backboard.

To counterbalance the weight of the backboard 175 and hoop 170 when the adjustment system 150 is unlocked and movable, a gas shock 160 or 165 may be connected at either of the positions shown in FIG. 1A. It is also contemplated that an air spring, an extension spring, a constant force spring or other similar means for counterbalancing may be used as opposed to a gas shock without deviating from the scope and spirit of the present invention. Additionally, while a gas shock 160, 165 may placed at either or both of the locations shown in FIG. 1A, it would be apparent to one of skill in the art that the gas shock may be positioned at varying points on the basketball goal system 100 without deviating from the scope and spirit of the present invention. As shown, the shock 160 applies a downward force to the adjustment pole 132 which may be configured to be substantially equal to the upward force applied to the adjustment pole 132 from the weight of the backboard 175 and the hoop 170.

Unfortunately, as the shock 160 ages and degrades, the shock 160 may not adequately oppose the forces of the weight of the backboard 175 and the hoop 170, resulting in additional strain on the adjustment system 150 and additional effort required to move the height of the basketball goal. Further, as would be apparent to those of skill in the art, the mechanical advantage of the mechanical linkages varies with the height. As such, the load on the adjustment system 150 and the ability of the shock 160 to counterbalance the weight of the backboard 175 and the hoop 170 may vary with any change in height.

Figure 1B:
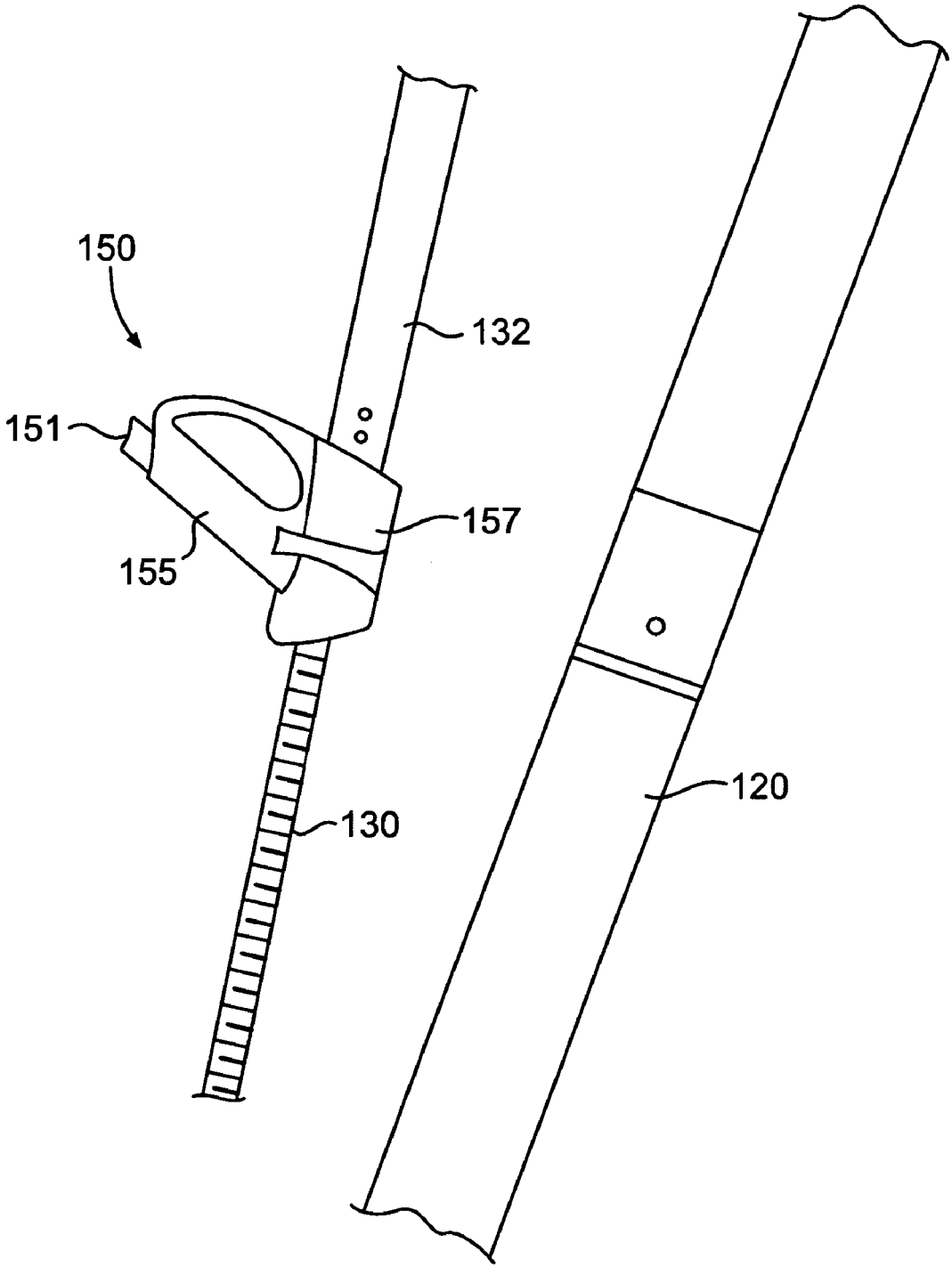
FIG. 1B shows a side view of an embodiment of the adjustment system of the present invention.

FIG. 1B shows a side view of an embodiment of the adjustment system 150 according to the present invention. The adjustment system 150 may include a handle portion 155, an attachment portion 157 and a locking trigger 151. As shown in FIG. 1B, the attachment portion 157 may rigidly attached to the first adjustment pole 132 and may be integrally formed with the handle 155. However, in other embodiments, it is contemplated that the handle portion 155 and the attachment portion 157 may be formed of two separate pieces that may be mechanically fastened together in any manner known to one of skill in the art. The handle portion 155, the trigger 151, and the attachment portion 157 may be formed of molded plastic, shaped metal, wood or other materials known in the art.

Additionally, it is contemplated that the shape of handle portion 155 and attachment portion 157 may be vary in shape, position, and otherwise without deviating from the scope and spirit of the present invention.

As discussed in detail below, the trigger 151 may be movably attached to the handle portion 155 such that, by depressing the trigger, the adjustment system 150 may be moved along the axial length of the threaded rod 130. When activated, the trigger 151 may unlock the adjustment system 150 such that the position of the adjustment pole 132 on the threaded rod 130 may be changed, effectively changing the height of the backboard 175 and the hoop 170.

Figure 2A:
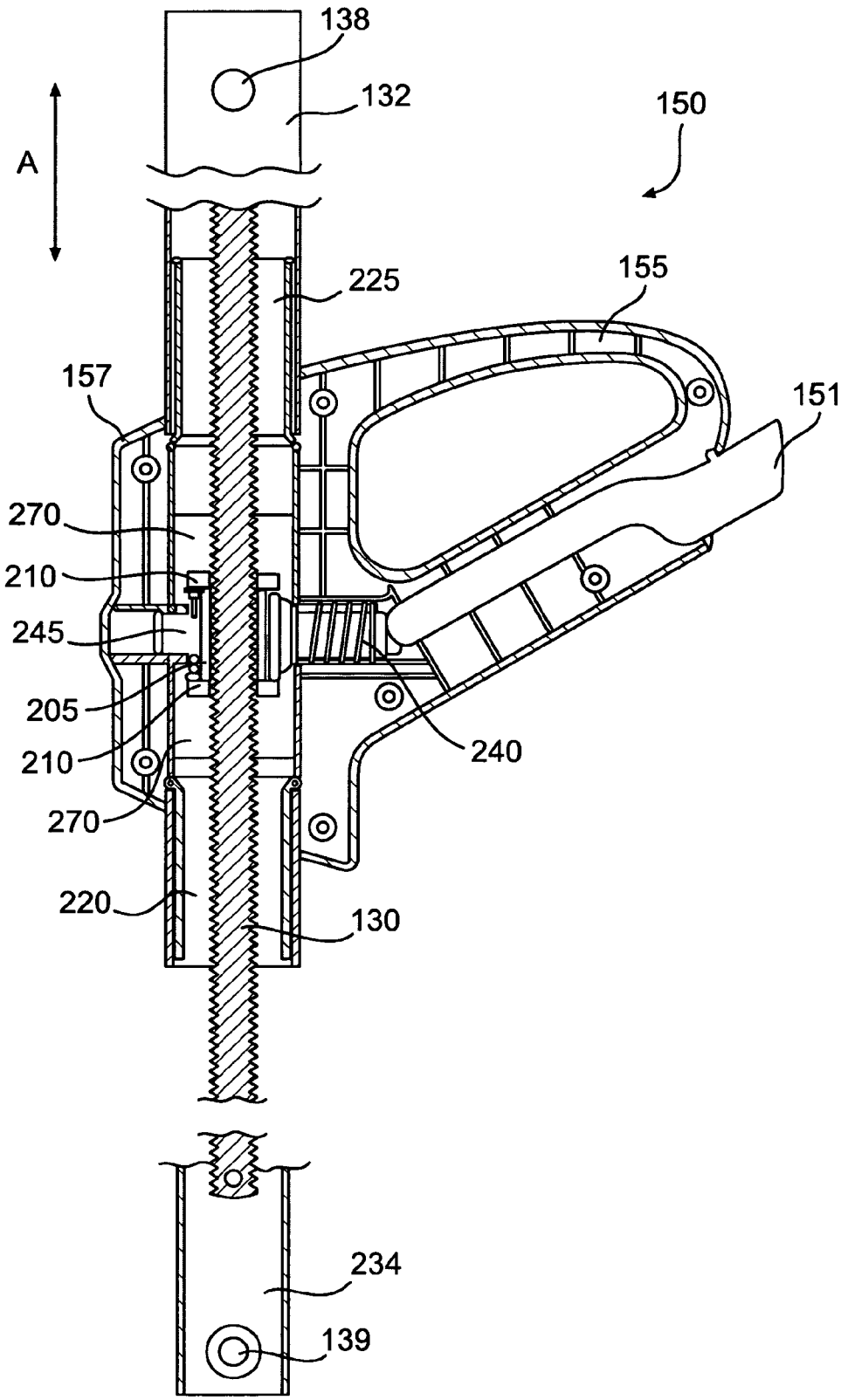
FIG. 2A shows a side cross-sectional view of an embodiment of the adjustment system of the present invention.

FIG. 2A shows a side cross-sectional view of an embodiment of the adjustment system 150 according to the present invention. The adjustment system 150 may include an adjustment nut 205 and thrust bearings 210 mounted on either side of the adjustment nut 205. As shown in FIG. 2A, the adjustment nut 205 may include hi-lead threads with a pitch angle greater than approximately five degrees. Hi-lead threads are non-locking which allows the nut to spin easily on the threaded rod 130 in response to a upward or downward force being applied to the adjustment nut 205 from the thrust bearings 210. Although shown and described as an adjustment nut with hi-lead threads, it would be apparent to those of skill in the art that other types of nuts and threads may be employed without deviating from the scope and spirit of the present invention.

As shown in the attachment portion 157, the adjustment nut 205 may be held in the attachment portion 157 between the thrust bearings 210 or any similar device known in the art. The thrust bearings 210 may be held in place and positioned by an insert 270, which may configured as a hollow spacer so that the threaded rod 130 may pass through.

As discussed earlier with reference to FIGS. 1A and 1B, the adjustment system 150 may be attached to the first adjustment pole 132. As shown in FIG. 2A, the adjustment system 150 may be movably attached to the threaded rod 130 by threadably engaging the adjustment nut 205 on the threads of the threaded rod 130. On the far end, the threaded rod 130 may be attached to the pole 120 or other stationary fixture using the adapter 234 and the rotatable connection 139. As would be apparent to those of skill in the art, the threaded rod 130 may be connected to the adapter 234 and, consequently, pole 120 using any type of mechanical fastening means known in the art including screws, bolts, rivets or welding.

The attachment portion may also include two spacers 220, 225 positioned above and below the adjustment nut 205. It is contemplated the spacer 225 may transition between the attachment portion 157 and the adjustment pole 132. Although not shown in FIG. 2A, the spacer 220 may function as a connection between the attachment portion 157 and any telescoping covering discussed above with reference to FIG. 1A and the covering of the threaded rod 130. As with the inserts 270, the spacers 220 and 225 may be configured to allow the threaded rod to pass through the spacers and the attachment portion 157.

Referring to FIG. 2A, the locking mechanism 245 is shown in the locked position, engaging the adjustment nut 205 such that rotation about the threaded rod 130 may be stopped. A spring 240 may be configured to bias the locking mechanism 245 to the right, as shown in FIG. 2A. The locking mechanism 245 may be unlocked, or moved to the left of the position shown in FIG. 2A, by depressing the trigger 151. Once the trigger 151 is depress and the locking mechanism 245 disengaged from the adjustment nut 205, adjustment of the height of the backboard 175 and hoop 170 may be accomplished. While locking mechanism 245 is illustrated in the figures as a spring-biased trigger, it is contemplated that any common braking mechanism may be used to prevent rotation of the adjustment nut 205 about the threaded rod 130 without deviating from the scope and spirit of the present invention.

Once unlocked, the adjustment system 150 may be moved upward or downward in the vertical direction indicated by Arrow A. By applying downward pressure, the thruster bearings 210 may apply downward force to the adjustment nut 205, causing the nut 205 to spin. Once spinning, the nut 205 may permit the threaded rod to pass through the attachment portion 157 of the adjustment system 150. As the nut 205 spins, the threaded rod 130 may extend through the attachment portion 157 and upwardly into the adjustment pole 132, effectively shortening the distance between point 138 to point 139. Conversely, by applying an upward force on the adjustment system 150, the nut 205 may spin, the threaded rod 130 may translate down relative to the adjustment pole 132, and the effective distance between point 138 and 139 may be increased.

While the figures illustrate the adjustment nut 205 spinning around the threaded rod 130 while the threaded rod 130 is held in a stationary position, it is also contemplated that the spinning nut 205 may be held stationary and the threaded rod 130 may rotate. In this embodiment, the threaded rod 130 may be attached to the first adjustment pole 130 in a manner so as to allow the threaded rod to rotate about its longitudinal axis and the adjustment nut 205 may be held stationary within the adjustment mechanism 150. Further, a braking mechanism may be attached to the threaded rod 130 so as to prevent rotation and thus lock the vertical height of the basketball backboard 175 and hoop 170.

It should be noted that, according to the embodiment shown in FIG. 2A, translation between the adjustment pole 132 and the threaded rod 130 requires that the adjustment nut 205 spin in a predetermined direction. Additionally, the threaded rod 130 may be prohibited from sliding or becoming disconnected from the adjustment pole 132 because of the threads engaging the adjustment system 150 with the threaded rod 130. As a result, even large and sudden forces or energies, such as the weight of the basketball backboard and goal or a player hanging on the rim may have to be first converted into rotational energy of the nut in order to the height to change before any translation of the threaded rod 130 and the adjustment pole 132 may take place. Because such energies are translated into rotation of the adjustment nut 205, the transition between a stationary adjustment system 150 and a moving adjustment system 150 may be smooth, without any sharp movements or jumps.

Figure 2B:
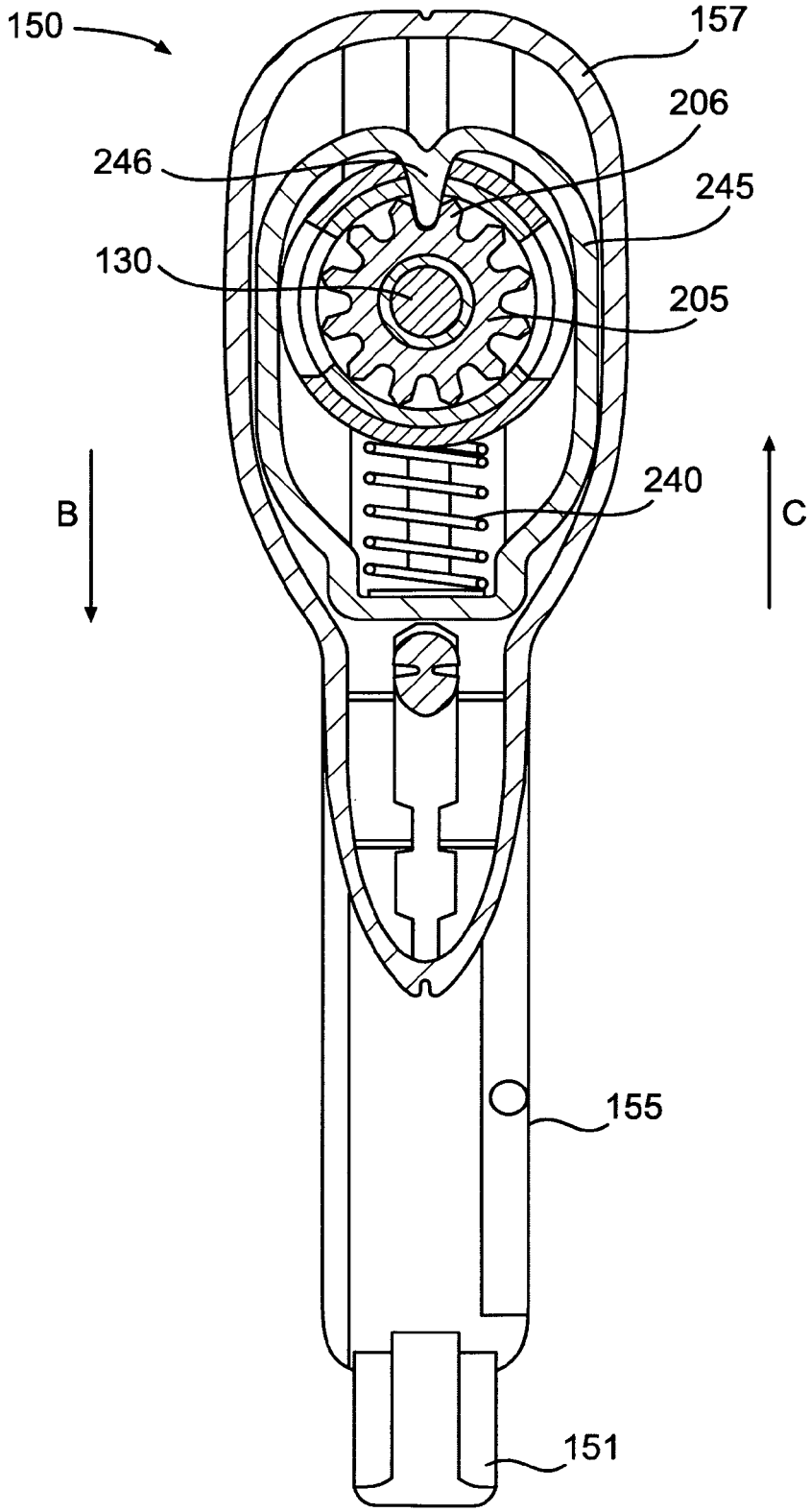
FIG. 2B shows a top cross-sectional view of an embodiment of the adjustment system of the present invention.

FIG. 2B shows a top cross-sectional view of an embodiment of the adjustment system according to the present invention. As shown in FIG. 2B, the locking mechanism 245 may have an engagement portion or tooth 246 configured to engage with the adjustment nut 205. The locking mechanism 245 may be held in place in its resting position by the spring 240 which may exert a force on the locking mechanism 245 in the direction of Arrow B. While in its released position, where the trigger 151 remains inactivated, the engagement portion 246 may engage with exterior of the adjustment nut 205, preventing any rotation of the adjustment nut 205 around the threaded rod 130.

When a user depresses the trigger bar 151, a force may be applied to the spring 240 in the direction of Arrow C and the locking mechanism 245 may disengage with the adjustment nut 205. As such, the adjustment nut 205 may be permitted to turn around the threaded rod 130. While FIGS. 2A and 2B illustrate the use of a spring 240 and a trigger bar 151 for engaging with the locking mechanism 245, it is contemplated that other locking mechanisms, including electronic systems, known to those in the art may be used without deviating from the scope and spirit of the present invention.

The attachment of the threaded rod 130 to the adjustment system 150 in the manner described above and the use of a locking mechanism 245 may permit a user to easily adjust the height of a basketball system using the present invention. Using the present invention, the adjustment system 150 may be moved by a user in the directions indicated by Arrow A in FIG. 2A along the axial direction of the threaded rod 130 with relative ease. As the adjustment system 150 moves along the length of the threaded rod 130, the first adjustment pole 132 may be pulled downwards or pushed upwards, easily increasing or decreasing the height of the backboard/hoop assembly.

Unlike traditional systems, the use of an adjustment nut 205 and threaded rod 130 permit a user to make smooth, precise adjustments in the height of a basketball system by pushing and pulling rather than having to rotate the adjustment mechanism. For example, according to one embodiment of the present invention, the hi-lead threaded rod 130 and an adjustment nut 245 may each include threads configured for 0.5 inch of travel per revolution, resulting in 0.042 inch of vertical adjustment in the height of the basketball hoop 170.

Furthermore, the locking mechanism 245 and the locking tooth or engagement portion 246 may engage the threaded nut 205 and the intervals between external teeth 206 to substantially prohibit rotation of the threaded nut 205 and substantially fix height of the basketball backboard 175. As would be apparent to one of ordinary skill, the threaded nut 205 may include twelve external teeth 206, as shown in FIG. 2B, resulting in twelve intervals at which the threaded nut and the height of the backboard may be set per each revolution of the threaded nut. However, according to the present invention, different size, shape, and number of external teeth may be used. Contrary to the traditional adjustable basketball systems, the resolution resulting from the external teeth 206 and the locking mechanism 245 may be configured to provide very fine and precise adjustment of the height of the basketball hoop.

Although the adjustment system 150 may be configured as shown in FIGS. 1A-2B, it should be understood that alternative configurations and designs may be employed without deviating from the scope and spirit of the present invention.

The foregoing descriptions of specific embodiments of the present invention are presented for purposes of illustration and description. They are not intended to be exhaustive or to limit the invention to the precise forms disclosed. Obviously, many modifications and variations are possible in view of the above teachings. While the embodiments were chosen and described in order to best explain the principles of the invention and its practical applications, thereby enabling others skilled in the art to best utilize the invention, various embodiments with various modifications as are suited to the particular use are also possible. The scope of the invention is to be defined only by the claims appended hereto, and by their equivalents.

What is claimed is:

1. An apparatus for adjusting the height of a basketball backboard and hoop, the apparatus comprising:

a support pole;

at least one elevator arm rotatably connected to said basketball backboard and rotatably connected to said support pole;

an adjustment pole having a first end and a second end, the first end being rotatably connected to said at least one elevator arm; a threaded rod having a first end movably attached to the second end of said adjustment pole and a second end rotatably connected to the first end of said support pole; a threaded nut attached to said adjustment pole and configured to threadably engage with said threaded rod; and wherein rotation of said threaded nut adjusts the height of said basketball backboard and hoop.

2. The apparatus according to claim 1, wherein said threaded rod and said threaded nut include hi-lead threads.

3. The apparatus according to claim 1, wherein said adjustment pole includes an adjustment mechanism configured to rotatably attach said threaded nut to said adjustment pole.

4. The apparatus according to claim 3, wherein said adjustment mechanism further comprises:

a locking mechanism configured to prevent said threaded nut from rotating; and a trigger having a first position in which said locking mechanism prevents said threaded nut from rotating and a second position in which said locking mechanism permits said threaded nut to rotate.

5. The apparatus according to claim 3, wherein said adjustment mechanism includes at least two thrust bearings positioned on opposite sides of said adjustment nut, the two thrust bearings configured such that said threaded rod passes through the two thrust bearings, said threaded nut, and said adjustment mechanism.

6. An apparatus for adjusting the height of a basketball backboard and hoop, the apparatus comprising:

a support pole;

at least one elevator arm rotatably connected to said basketball backboard and rotatably connected to said support pole; and an adjustment device connecting said at least one elevator arm to said support pole, the adjustment device having a threaded rod in telescoping engagement with an adjustment arm, the adjustment device further having a threaded nut rotatably connected to the adjustment arm and threadably engaged to the threaded rod, the threaded nut being configured to rotate in response to a force applied to the adjustment arm;

wherein rotation of the threaded nut adjusts the height of said basketball backboard and hoop; wherein the threaded rod has a first end and a second end, the first end being movably attached to the adjustment arm and the second end being rotatably connected to said support pole; and wherein the adjustment arm has a first end and a second end, the first end being movably attached to the threaded rod and the second end being rotatabiv connected to said at least one elevator arm.

7. The apparatus of claim 6, wherein the threaded rod and the adjustment arm are movably attached by the threaded nut.

8. The apparatus according to claim 6, wherein the threaded rod and threaded nut are formed using hi-lead threads.

9. The apparatus according to claim 6, wherein the adjustment arm includes an adjustment mechanism configured to rotatably connect the threaded nut to the adjustment arm.

10. The apparatus according to claim 9, wherein the adjustment mechanism further comprises:

a locking mechanism configured to prevent the threaded nut from rotating; and a trigger having a first position in which the locking mechanism prevents the threaded nut from rotating and a second position in which the locking mechanism permits the threaded nut to rotate.

11. The apparatus according to claim 10, wherein the adjustment mechanism includes at least two thrust bearings positioned on opposite sides of the adjustment nut, the two thrust bearings configured such that the threaded rod passes through the two thrust bearings, the threaded nut, and the adjustment mechanism.

12. The apparatus according to claim 1, wherein said threaded rod is rotatably connected to said support pole and movably connected to said adjustment pole.

* * * * *